United States Patent [19]

Alley et al.

[11] 4,191,309

[45] Mar. 4, 1980

[54] PRODUCT PORTIONING IN THE CONTINUOUS PUMPING OF PLASTIC MATERIALS

[75] Inventors: Lewis F. Alley, Kansas City, Mo.; James E. White, Overland Park, Kans.

[73] Assignee: Marlen Research Corporation, Overland Park, Kans.

[21] Appl. No.: 854,355

[22] Filed: Nov. 23, 1977

[51] Int. Cl.[2] ..... B67D 5/22; G01F 11/16

[52] U.S. Cl. ..... 222/1; 17/39; 222/14; 222/37; 222/57; 222/217

[58] Field of Search ..... 222/23, 36–38, 222/57, 61, 63, 216, 217, 333, 334, 134, 14–20, 1, 56, 59; 137/87, 99, 557; 417/12, 339–344, 469, 900; 17/35, 38, 39; 91/434, 433 R, 363 R, 1; 60/593, 547 R

[56] References Cited

U.S. PATENT DOCUMENTS

| | | | |
|---|---|---|---|
| 2,759,633 | 8/1956 | Ross | 222/16 |
| 2,770,395 | 11/1956 | Sebardt | 222/23 |
| 3,266,433 | 8/1966 | Mason | 222/217 |
| 3,360,094 | 12/1967 | Romanowski | 194/13 |
| 3,473,189 | 10/1969 | Middleton | 17/39 X |
| 3,613,951 | 10/1971 | Muir | 222/36 |
| 3,756,456 | 9/1973 | Georgi | 222/14 X |
| 3,847,511 | 11/1974 | Cole | 417/342 |
| 3,890,922 | 6/1975 | Nordenholt | 222/334 X |
| 3,981,622 | 9/1976 | Hall et al. | 417/344 X |
| 4,036,564 | 7/1977 | Richards | 417/469 X |

*Primary Examiner*—Robert J. Spar
*Assistant Examiner*—Edward M. Wacyra
*Attorney, Agent, or Firm*—Schmidt, Johnson, Hovey & Williams

[57] ABSTRACT

A viscous products pumping machine meters the volume of product that it dispenses by simultaneously displacing a proportionate amount of fluid through a separate metering circuit. The fluid of the metering circuit also serves as the medium for driving the pumping pistons of the machine, and provision is made for obtaining an accurate measurement notwithstanding any product of fluid leakage that might occur between the pistons during operation. A pneumatic logic control system governs sequencing of the machine operations, including control of a shut-off valve in the product discharge line that can be used to portion the pumped product according to the amount of fluid that has been displaced in the metering circuit.

6 Claims, 13 Drawing Figures

PRODUCT PORTIONING IN THE CONTINUOUS PUMPING OF PLASTIC MATERIALS

Figure 1:
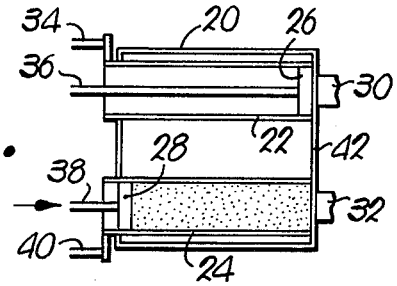

This invention relates to improvements in pumping machines of the type employed to dispense viscous or "plastic" materials such as food products and the like under pressure, and deals more particularly with a unique method of, and apparatus for, precisely metering the individual portions dispensed by such machines.

Prior pumping machines such as those disclosed in U.S. Pat. Nos. 3,108,318 and 3,456,285 received an essentially continuous bulk supply of products via a hopper or the like and could be regulated in such a way as to pump discrete portions of such products, often for purposes of stuffing food product containers, such as sausage casings for example. The manner of accomplishing such regulation had some shortcomings, however, such as the occasional under-filling of some casings and the over-filling of others to the point of bursting. Moreover, such regulation techniques often included the use of mechanisms which were exposed to the product flows, and where the latter consisted of a food product, this necessitated frequent sanitary clean-ups. The need to meter dispensed portions of food products without using metering means which directly contact such food products has become particularly important in recent times due to increasingly stringent sanitation standards for the food processing industry imposed by governmental authorities.

Accordingly, it is an important object of the present invention to provide a unique method of, and apparatus for, precisely metering the viscous material dispensed from a pumping machine without direct physical contact between the material itself and the apparatus used to meter the material.

Another important object of the present invention is to provide for accurate metering notwithstanding the fact that pumping is accomplished by the alternating action of a pair of separate pumping units within the same machine, coupled with countless numbers of valve openings and closings.

In carrying out the foregoing objects, a fluid circuit, separate and apart from the product flow circuit, experiences a fluid displacement simultaneously with and in proportion to the volume of product being dispensed so that, by measuring the amount of fluid displaced over any given increment of time, a corresponding figure for the volume of dispensed product can be obtained. Pursuant thereto, an additional important object of this invention is to utilize the metering fluid as the driving medium for the pumping units of the machine and thereby avoid the complexities and other shortcomings of multiple fluid circuits.

A further important object of the invention is to connect the metering apparatus with a shut-off valve in the product discharge line so that accurately defined, discrete portions of the product may be obtained by making the valve responsive to preselected fluid displacement values in the metering apparatus.

Yet another important object of our invention is to achieve accurate product metering in spite of a period in each pumping cycle during which product is only compressed by the pumping mechanism (in readiness for pumping) and not actually pumped.

RELATED PRIOR ART

Prior art known to applicants is disclosed in U.S. Pat. No. 2,770,395, issued Nov. 13, 1956, to Wilhelm Sebardt.

Figure 13:
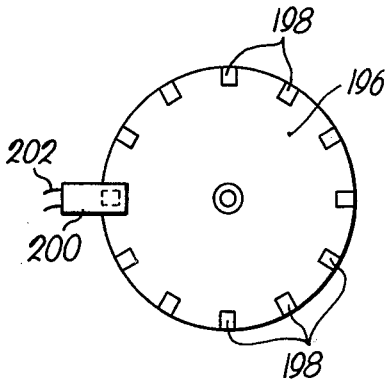
Figure 11:
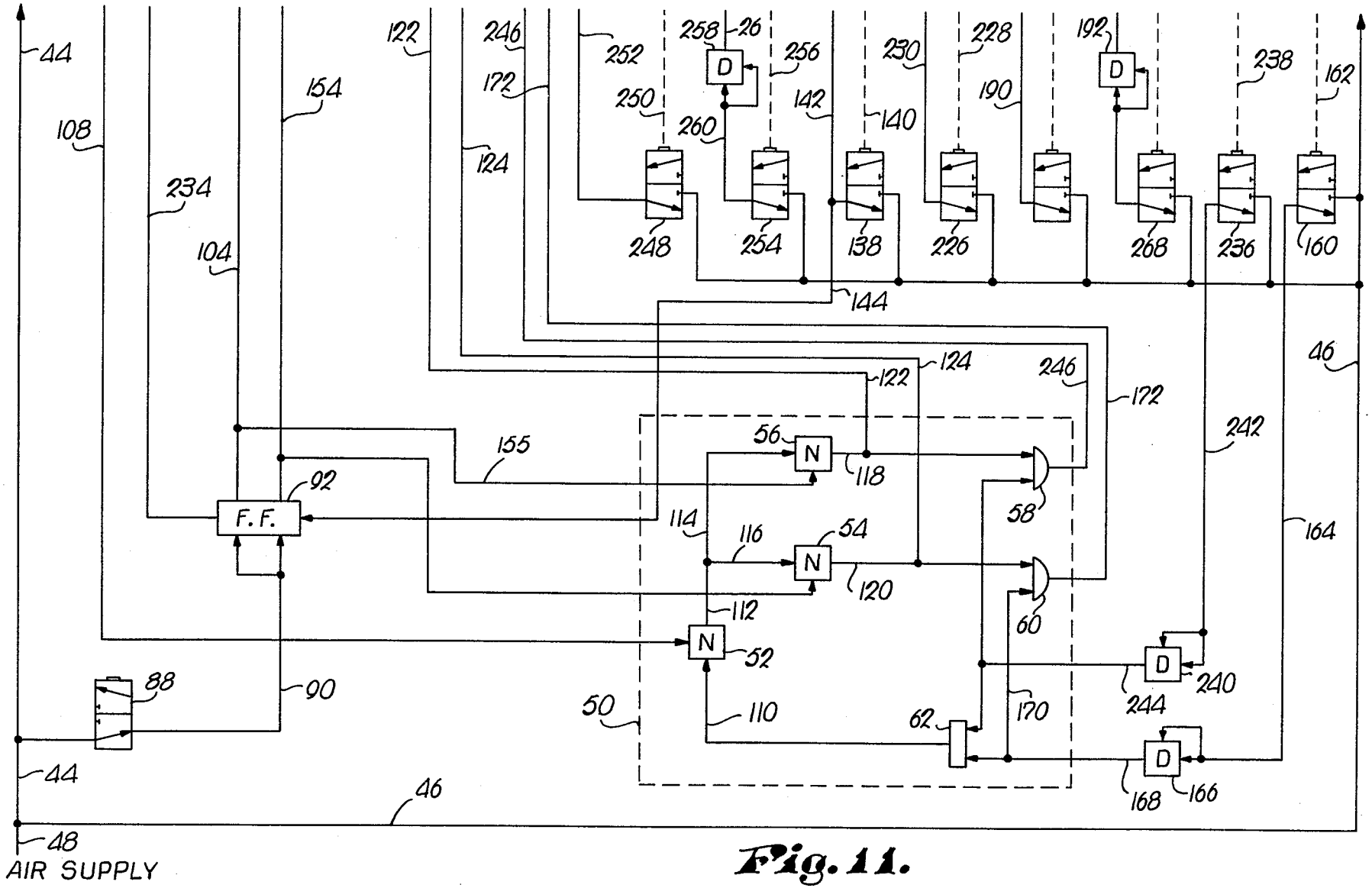
Figure 12:
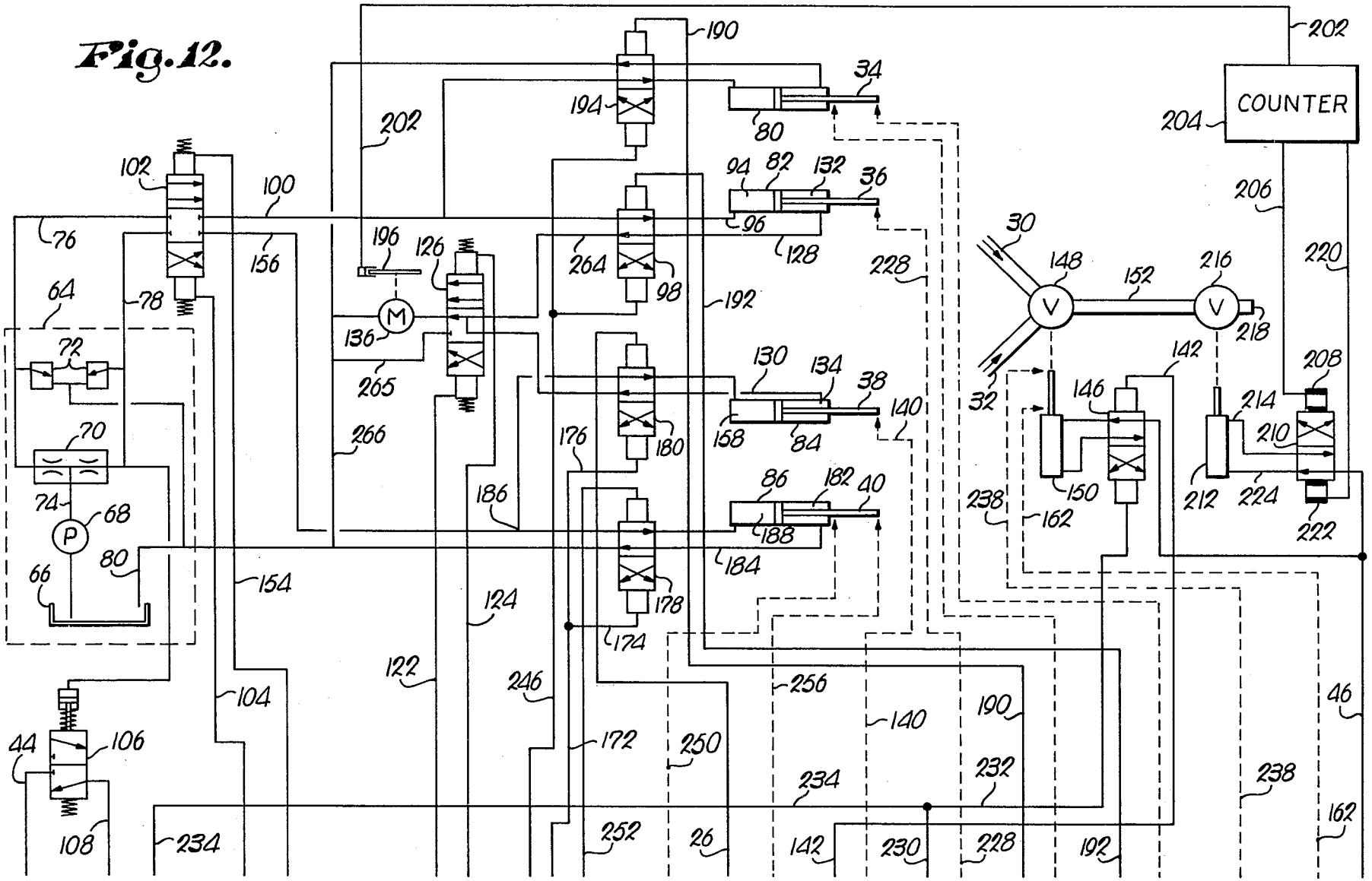

In the accompanying drawings, which form a part of the specification and are to be read in conjunction therewith, and in which like reference numerals are employed to indicate like parts in the various views;

FIGS. 1 through 10 are diagrammatic representations of a pair of viscous material pumping chambers employed in a machine constructed in accordance with the principles of the present invention, such figures showing the operational sequence comprising an essentially complete cycle in the dispensing of product from each of the said chambers;

FIGS. 11 and 12, taken together, comprise a schematic diagram of a product portioning system in a continuously pumping food product machine; and FIG. 13 is a front elevational view of a rotatable, fluid measuring wheel having a plurality of circumferentially spaced-apart metal contacts secured to the periphery thereof, and a means for sensing said contacts, stationarily mounted adjacent said wheel.

It will be helpful in understanding the general nature of the invention to refer first to FIGS. 1 through 10 wherein the operational sequence is depicted during the pumping of food products or the like from a viscous materials pumping machine. The invention contemplates the use of a pumping machine of the type having a box-like container 20 into which product is continuously fed, as through a hopper (not shown). The container 20 is thus essentially completely full of product except when either of a pair of pumping chambers, defined by sliding, cylindrical sleeves 22 and 24 and their respectively associated pistons 26 and 28, operate to pump a quantity of such product from said container through chamber outlets 30 and 32. Motor means such as hydraulic cylinders or the like (not shown) are coupled with the respective connecting rods indicated by the numerals 34, 36, 38 and 40 to produce the desired sliding movement of sleeves 22 and 24 in and out of container 20, as well as the pumping effect by pistons 26 and 28. A later discussed hydraulic control system is uniquely employed to selectively drive the aforementioned hydraulic cylinders in a dual pressure mode of operation.

The two pump units defined by the sleeve 22, piston 26, and the sleeve 24, piston 28, operate substantially in alternating action to force products alternately from the container 20 through the outlets 30 and 32. However, the two outlets 30 and 32 are merged together downstream from the container 20 at a junction point controlled by a check valve designated by the numeral 148 in FIG. 12. Thus, while product is only flowing through one or the other of the two outlets 30 and 32 at any one given point in time, their convergence into a common discharge line (designated 152 in FIG. 12), coupled with the precise timing of the alternating action, means that a continuous stream of product emanates from the machine through the line 152.

Figure 2:
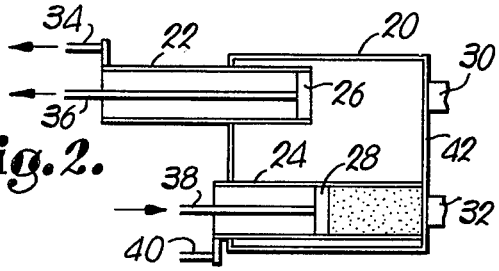
Figure 3:
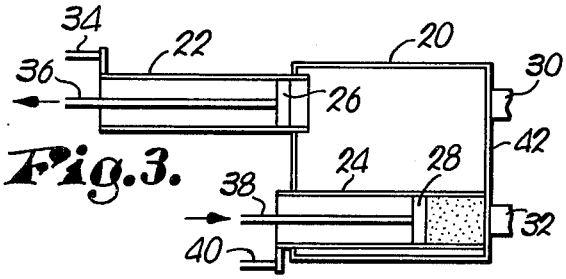

In FIG. 1, sleeve 22 is shown seated against the outlet wall 42 of the container 20 and piston 26 has traveled to its position of maximum displacement and dispensed a full volume of product, while sleeve 24 has likewise seated and piston 28 is being operated under high pressure to commence pumping product within sleeve 24 through outlet 32. In FIG. 2 the piston 26 having completed its displacement stroke, it returns in unison under low pressure with its respective sleeve 22 while piston 28 continues to pump under the influence of high pressure. In FIG. 3, piston 28 is still in its high pressure pumping cycle while the combination of piston 26 and sleeve 22 has reached its point of maximum retraction. Sleeve 22 will now start its reload stroke by moving back toward outlet wall 42 and in the process will slice through the awaiting product in container 20 so as to "capture" a cylinder of the product ahead of piston 26.

Figure 4:
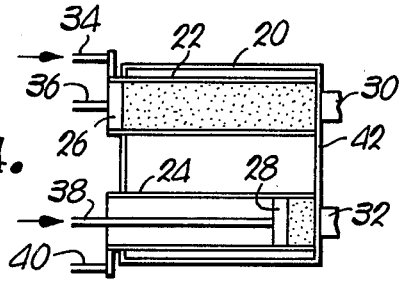
Figure 5:
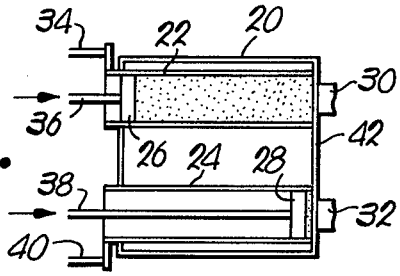

FIG. 4 shows further progress of piston 28 in its pump stroke while sleeve 22 has just completed its reloading of product by seating against the outlet wall 42 whereupon, as shown in FIG. 5, piston 26, still being driven by low hydraulic pressure, moves ahead in the sleeve 22 a relatively short distance in an effort to pump and displace food product therewithin. However, the low pressure driving said piston 26 is insufficient to actually pump the product through chamber outlet 30, and as a consequence, the piston 26 "stalls" and merely serves to "precompress" the product within sleeve 22.

This precompression stroke is significant since viscous materials, and particularly food products having larger particle sizes, tend to include voids or "air pockets" therein and, thus, may actually comprise a significant amount of air. The dispensing of relatively void-free food products is naturally desirable in a number of packaging applications; however, as will become later apparent, the precompression of the food product permits subsequent accurate metering of portions of the food product to be dispensed.

Figure 6:
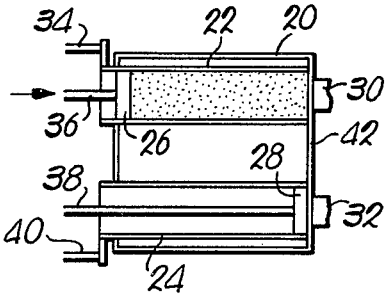
Figure 7:
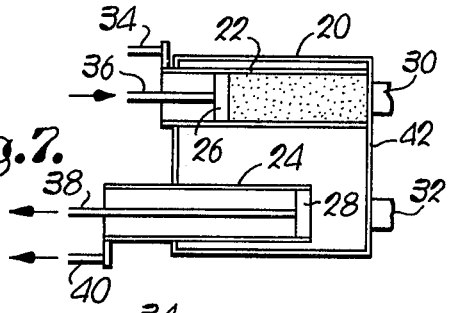

Returning now to the operational sequence, piston 26 remains stalled until piston 28 completes its pumping stroke as it has so done in FIG. 6, whereupon the hydraulic control system switches high hydraulic driving pressure to piston 26 while simultaneously switching low pressure to piston 28 for the latter's return stroke. It is evident at this point that the operational relationships shown in FIGS. 1 and 6 are similar with the states of the two pumping chambers being reversed. The pressure to piston 26 having gone high, said piston is enabled to pump the precompressed product through outlet 30 as shown in FIG. 7, while the combination of sleeve 24 and piston 28 simultaneously retracts under low pressure.

Figure 8:
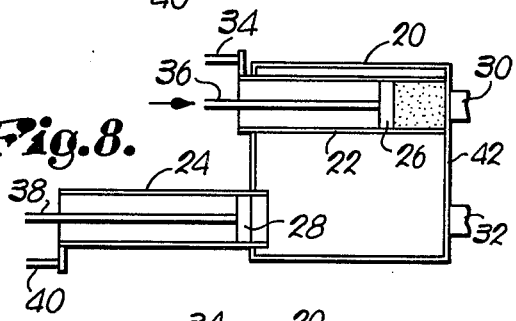
Figure 9:
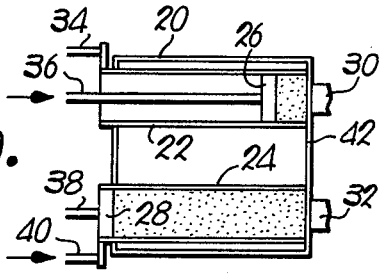
Figure 10:
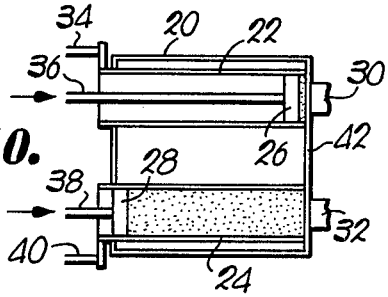

In FIG. 8 the combination of sleeve 24 and piston 28 is fully retracted while piston 26 continues to pump under high pressure; in FIG. 9 sleeve 24 has reloaded, with piston 26 still pumping; in FIG. 10 piston 28 has completed its precompression stroke under low pressure shortly prior to piston 26 completing its pumping stroke.

Before going further, and inasmuch as the basic operational aspects of the pumping operation are now fully clear, a brief summation of the detailed description of the metering aspects of the invention yet to follow would appear to be in order. Simply stated, instead of directly measuring the volume of product flow within the discharge line 152, such flow is indirectly measured by noting the amount of displacement of fluid in another part of the machine which simultaneously and proportionately undergoes displacement during each pumping stroke of each of the pistons 26, 28. In other words, it is not the product within the product flow circuit that is measured, but rather the fluid within a separate metering circuit that is measured.

In the preferred embodiment, the fluid being metered is the same fluid that is used to drive the pistons 26 and 28. Hence, the amount that the fluid drives the pistons has a direct bearing on the increments of fluid that are indicated as being displaced. However, there are certainly times when movement of the pistons is desirably not reflected in an indication that additional fluid increments have been displaced such as, for example, during the "precompression" strokes when no product is actually being pumped by the piston accomplishing such precompression, and during retraction strokes of the pistons.

Accordingly, special valving and circuitry is employed in order to have flow of the fluid being metered past the metering station only when product is, in fact, being displaced through the discharge line 152. Such valving and circuitry not only assures metering during the positive pumping stages of the cycle, but also operates to effectively "subtract" from the indicated total of metered fluid in the event that the product from one piston accidentally leaks past the valve 148 to cause unintentional retraction of the other piston.

The fluid being metered drives a hydraulic motor whose angular displacement is sensed electronically by a counter that not only registers a readable count, but also can be used to actuate a shut-off valve in the main discharge line 152 (designated by the numeral 216 in FIG. 12). By setting the counter such that the valve 216 is actuated when a predetermined count has been achieved, discrete product portions may be dispensed from the line 152 on the downstream side of the valve 216 in proportion to the volume of fluid that has been displaced, and the portions so produced may be any desired fraction of the product volume displaced during each discharging stroke of a piston, or may comprise the volume from more than one stroke.

Attention is now directed to FIGS. 11 and 12 wherein the control system for the present invention is displayed schematically. The control system broadly includes a fluid-pressure or "hydraulic-" type control system cooperatively interconnected with a second control system that may be pneumatic or electric but has been illustrated by way of example as pneumatic. The pneumatic system receives power via pneumatic supply lines 44 and 46 derived from air supply 48 which is preferably of the filtered- and regulated-pressure-type, and includes a number of air-powered logic control elements such as "AND's ," "OR's ," "NOT's ," and "FLIP-FLOP's ." These logic elements are well-known in the art of pneumatic logic control and it will suffice here to note that such standard elements are connected and operated in the normal manner. However, several of such elements are of particular interest since they comprise the "portioning logic" which is generally indicated within the broken line 50 and includes: NOT's 52, 54 and 56; AND's 58 and 60; and OR 62.

The hydraulic portion of the control system includes a fluid supply means generally designated with a broken line 64 which comprises a source of hydraulic fluid 66, fluid pump 68, flow splitter 70 and a pair of hydraulic relief valves 72. The flow splitter 70 is of a standard type and is employed herein to respectively divert preselected portions of the fluid received from pump 68 on hydraulic line 74 to the outgoing hydraulic lines 76 and 78; in the present embodiment, a smaller portion of fluid is supplied to line 76 than line 78, and, thus, line 76 becomes the "high pressure" supply line while line 78 is a "low pressure" supply line. The flow splitter 70 is operative to maintain the relative proportions of fluid within the respective lines 76 and 78, whereby to hold the pressure within such lines at a relatively constant level. Line 80 provides a return from the hydraulics control system to the fluid source 66.

As previously mentioned with reference to FIGS. 1 through 10, hydraulic cylinders are employed to operate the sleeve and piston combinations during the product pumping sequences. The priorly mentioned connecting rods 34 through 40, which were described as being coupled to the sleeve and piston combinations, are likewise shown in FIG. 12 along with their respectively associated hydraulic cylinders 80, 82, 84 and 86. It, therefore, follows from the foregoing that cylinder pair 80 and 82 operates sleeve 22 and piston 26, respectively, while cylinder pair 86 and 84 likewise operates sleeve 24 and piston 28, respectively.

While maintaining attention to FIGS. 11 and 12, further description of the control system and operation thereof will now be provided with concurrent reference to the various operational sequences depicted in FIGS. 1 through 10. The control system is initially enabled by manually actuating the normally open, air start switch 88 which places the supply line 44 in pneumatic communication with pneumatic line 90, the latter forming a dual input to FLIP-FLOP 92. Assume now, for illustrative purposes, that the control system is conditioned in a state corresponding to an interim sequence, between the sequences depicted in FIGS. 4 and 5, wherein piston 26 has reached its maximum point of retraction and has subsequently effected at least partial precompression of the food product. Piston 26 is operating under "low pressure" at this point, and experiences a back pressure caused by the resistance of the food product thusly precompressed. This back pressure is realized in the pumping chamber 94 of cylinder 82 and is transmitted via hydraulic line 96 to one hydraulic input of the air actuated, four-way hydraulic valve 98, thence on hydraulic line 100 to one hydraulic input of the triple position, four-way-coupled valve 102. Valve 102 at that time is in its "set" position ("vertically" from that illustrated) by virtue of a signal having been received at the set actuating input thereof from pneumatic line 104, as derived from an output of FLIP-FLOP 92. Thus, line 100 is placed in communication with line 78, the latter line being traceable as a switching input to the hydraulically actuated air valve 106. Valve 106 is of the spring-loaded, momentary closing-type which includes means for presetting the hydraulic input pressure level at which its air input and output are switched. When such preset pressure level is reached on line 78, valve 106 is actuated, to place the pneumatic supply line 44 in communication with the pneumatic line 108, the latter line comprising a primary input to the portioning logic 50, and more particularly forming one input to NOT 52. The signal thusly delivered on line 108 may be considered to be a precompress signal, indicating that the food product has been precompressed to a desired pressure level, as determined by the above-mentioned pressure setting of valve 106. Upon receipt of air supply via line 108 to NOT 52, the pneumatic output of said NOT on line 112 is turned off, or goes "low," said low signal being delivered via branch lines 114 and 116 to NOT's 56 and 54, respectively. Ordinarily, one of the output lines of NOT's 54 and 56 is in an "on" or "high" state at this point and with the inputs 114 and 116 to said NOT's having gone low, the outputs of each of same likewise go low, said low outputs being delivered via branch lines 122 and 124 to the air inputs of the three position hydraulic four-way valve 126. As will become apparent below, valve 126 is particularly important in the operation of the control system since it controls the point in time when the metering of the food product being pumped is initiated.

Upon receipt at valve 126 of a low signal at both of its air actuating inputs, said valve assumes its normal, centered position wherein hydraulic lines 128 and 130 (which are in respective communication with the retract chambers 132 and 134) are placed in common connection with each other and with hydraulic motor 136. At this point, the system is conditioned to a state corresponding to FIG. 5 wherein piston 26 has stalled while piston 28 is pumping, and remains so conditioned until the sequence depicted by FIG. 6 is reached, wherein piston 28 has achieved its point of maximum pumping displacement.

It is significant to note here that the volume of fluid in retract chamber 132 is in direct known proportion to the volume of precompressed food product entrapped within sleeve 22. When piston 28 reaches its maximum displacement as in FIG. 6, connecting rod 38 trips mechanically actuated air valve switch 138 (such mechanical connection being indicated by the broken line 140) which connects air supply line 46 to pneumatic lines 142 and 144. The resulting "high" on line 142 is delivered to the reset actuating input of the FLIP-FLOP coupled air actuated air valve 146 which, in turn, actuates a product check valve 148 via a cylinder 150 which may be pneumatically or hydraulically powered but is illustrated for hydraulic operation. Valve 148 is operably connected to the priorly discussed chamber outlets 30 and 32, and is of a dual-position-type to alternately allow product pumped from said outlets to flow through the common product flow line 152. Thus, upon receipt of the actuating signal on line 142, valve 148 checks off outlet 32 while placing outlet 30 in communication with line 152.

The "high" signal produced on line 144 is delivered to the set input FLIP-FLOP 92 which is responsive to bring line 104 low, while simultaneously transmitting a high signal via pneumatic line 154 to the reset input of the three-position hydraulic valve 102. Upon receipt of such signal, valve 102 is actuated from its set position (diagrammatically indicated on the crossed lines therewithin) to a "through" position (indicated by the parallel lines therewithin) whereby the low pressure line 78 is uncoupled from line 100 and recoupled to hydraulic line 156, while the high pressure line 76 is uncoupled from line 156 and recoupled with line 100. From the foregoing it is apparent then that, upon reaching completion of the pumping stroke of piston 28, high pressure is switched from the cylinder pumping chamber 158 for piston 28 to the cylinder pumping chamber 94 for the piston 26, thereby enabling piston 26 to overcome the resistance offered by the entrapped food product and pump the same through chamber outlet 30.

Returning now momentarily to the operation of the product check valve 148, the aforementioned actuation of the same likewise mechanically trips the mechanically actuated air valve switch 160 (such mechanical connections being indicated by the broken line 162), thereby placing the supply line 46 in communication with pneumatic line 164 which forms an input to the DIFFERENTIATOR 166, the latter element being responsive upon receipt of such air supply at its input to produce an output signal on line 168 in the nature of a single, or "one-shot" air pulse of relatively short duration. This one-shot pulse is delivered to the portioning logic 50, and more particularly to the OR element 62 thereof causing the latter's output to go high, said high then being delivered via line 110 to the input of NOT 52. NOT 52 responds to a high on its input by delivering a low via lines 112, 114 and 116 to NOT's 54 and 56. The input of NOT 54 having gone low, the output of same on line 120 goes high, said high being delivered to one input of AND 60, a second high input to said AND being delivered via line 170 and in the nature of said one-shot pulse produced by DIFFERENTIATOR 166. Both inputs to AND 60 having gone high, the output of same likewise goes high, said high output being delivered via output line 172 and branch lines 174, 176 to the set inputs of the four-way valves, respectively designated by the numerals 178 and 180. Valves 178 and 180 are responsive to these set inputs to place retract chambers 134 and 182 and their respectively coupled hydraulic lines 130 and 184 in common communication with the low pressure line 156 (via common connection 186), while simultaneously placing cylinder pumping chambers 158 and 188 in common communication with the hydraulic return line 80. Thus, cylinders 84 and 86 are conditioned to retract their rods 38 and 40 under low hydraulic pressure and thereby retract piston 28 and sleeve 24, respectively. By this point in time, previous high signals on pneumatic lines 190 and 192 to the reset inputs of the four-way valves 194 and 98, respectively, have them reset and ready to go. Recalling now that line 104 has gone low, and observing that said low is delivered by line 155 to supply of NOT 56, it is evident that the output of said NOT on branch line 122 also goes low, while the output of NOT 54, as previously noted, is in a high state; it follows then that a high signal is present at the reset input of valve 126, thus switching the same to couple chamber 134 with the return line 266 via line 265 while maintaining chamber 132 in communication with hydraulic motor 136. With piston 28 and sleeve 24 now retracting, as in FIG. 7, piston 26 is pumping food product through chamber outlet 30, and similarly the volume of fluid present within cylinder retract chamber 132 is being pumped via line 128 through valve 126 to drive hydraulic motor 136.

Referring now also to FIG. 13, the above-mentioned hydraulic motor 136 is driven by the fluid displaced from chamber 132 (and from chamber 134 in a later sequence), and has a rotatable disc member 196 mounted on an output drive shaft thereof. Disc member 196 has secured adjacent the periphery thereof a plurality of circumferentially spaced-apart actuating elements 198, such as metallic contacts. A sensing means 200 such as a metallic sensor is stationarily secured adjacent the periphery of disc 196 and is substantially aligned in a position of sensing communication with the actuating elements 198. As hydraulic motor 136 is being driven by the displaced fluid, disc member 196 is likewise driven to rotate, with the resulting angular displacement thereof being in direct relation to the amount of fluid being displaced. As the disc member 196 revolves, elements 198 successively traverse, and are thereby sensed, by sensing means 200. The circumferential spacing between adjacent ones of said plurality of element 198 being essentially equal, and the total number of such elements being known, then, a known relationship is pre-established between the number of said elements comprising said plurality thereof sensed by sensing means 200 during angular displacement of disc member 196, and the quantity of displaced fluid required to produce said angular displacement. Thus, as disc member 196 turns, sensing means 200 is operative to produce a "count" each time the presence of one of said plurality of elements 198 is sensed, each said count being representative of a known quantity of fluid displaced from chamber 132. Each of the counts successively produced by sensing means 200 is electrically transmitted via line 202 to counter 204.

Counter 204 may be pneumatic or, as illustrated, electronic, or may comprise any other suitable means for receiving, digitizing and accumulating the successively produced counts. We have chosen to employ an electronic counter in the present embodiment of the type which digitally displays the cumulative count produced by sensing means 200, and which further includes means to produce electrical control signals when said cumulative count is at least as great in magnitude as a preset count which may be preselected by the user, said preset count corresponding to the quantity of product which may be referred to as a "portion" of the same. It is important to note at this point that hydraulic motor 136, disc 196, sensing means 200 and counter 204 cooperate to provide a novel means for metering the displaced pumping fluid, as well as correlating the amount of metered fluid with the quantity of product being pumped. While we have employed electronic means to assess the angular displacement of the disc member 196, equivalent mechanical or electromechanical approaches to achieving this function could obviously be easily implemented. Moreover, it is apparent that correlation between the quantities of displaced fluid and associated product could be achieved in a number of known ways, including simple measurement of the flow rates of such quantities.

Recalling now that the volume of precompressed product within the sleeve 22 is in known porportion to the volume of fluid to be displaced from the retract chamber 132, and further observing that both said entrapped product and said fluid are simultaneously displaced at the same rate by virtue of the cylinder 82 acting as a common driving source therefor, the cumulative count registered by counter 204 is, therefore, indicative of the quantity of food product displaced or "pumped" by piston 26.

Upon receiving a start signal (either manual or automatic), counter 204 resets and produces a first electrical signal on line 206 to energize solenoid 208 which, in turn, switches the four-way valve 210 whereupon air supply line 46 is placed in communication with pneumatic cylinder 212 via line 214. Cylinder 212 is thereby energized to open the normally closed food product flow valve 216, thus allowing food product being pumped and displaced through chamber outlet 30 and line 152 to be finally dispensed by way of line 218 to a means for receiving a dispensed portion of the food product, such as a casing member.

Counter 204 may be altered to eliminate the above-mentioned step of comparing the cumulative count with the preset count, in which case continuous dispensing through the open valve 216 would ensue; in this case, of course, the cumulative count wiould merely represent the total quantity of food product which has been continuously dispensed from the machine. However, assuming for the present that it is desired to dispense discrete portions of the product, upon said cumulative count reaching said preset count, an electrical signal is delivered from counter 204 on line 220 to energize solenoid 222 which in turn actuates valve 210; valve 210 is operative to recouple air supply line 46 with a second line to the cylinder 212 indicated by the numeral 224, whereby to actuate said cylinder and thereby close valve 216 to terminate the flow of food product emanating from line 218 and, thus, defining a quantity of food product comprising said portion to be dispensed.

When piston 26 essentially reaches its point of maximum pumping displacement as in FIGS. 1 and 10, connecting rod 36 trips a mechanically actuated air valve switch 226 (such mechanical connections being indicated by the broken line 228) which places the air supply 46 in communication with pneumatic line 230 and branch lines 232 and 234. The resultant high signal on line 232 is delivered to the set input of the four-way valve 146, causing the latter to switch the product check valve 148 and thereby check off the chamber outlet 30 while opening line 152 to the chamber outlet 32. The high signal on branch line 234 is transmitted to the reset input of FLIP-FLOP 92, said FLIP-FLOP being then responsive to bring line 154 low while producing a high on line 104, said high being received at the set input of the valve 102. Valve 102 is responsive to the high on its set input to recouple the high pressure line 76 to line 156 and recouple the low pressure line 78 to the line 100.

Immediately prior to the completion of the pumping stroke of piston 26, the air-cylinder-operated, product check valve 148 is operative upon actuation thereof to likewise trip the mechanically actuated air valve switch 236 (via the mechanical connection designated by the broken line 238), said switch being then operative to place the air supply line 46 in communication with an input to the DIFFERENTIATOR 240 shown by the pneumatic line 242. The DIFFERENTIATOR 240 is responsive to the signal on its input to produce a one-shot pulse on its output line 244, similar to the output from DIFFERENTIATOR 166, said one shot being processed by the combinational logic comprising OR 62, NOT 52, NOT 56 and AND 58 to produce a high signal on line 246. The high on line 246 is then delivered to the set input of the four-way valves 98 and 194, thereby switching the latter and conditioning cylinders 80 and 82 to retract the sleeve 22 and piston 26, respectively.

Valves 178 and 180 have already been similarly switched prior in time as a result of a series of events brought about by the connecting rod 40 having tripped the mechanically actuated, air valve switch 248 (via mechanical connection 250) when sleeve 24 reached its point of maximum retraction. Such events may be traced as follows: valve 248 is operative to place air supply line 46 in communication with the reset input of valve 178 via line 252; valve 178 is thus switched whereby pumping chamber 188 is placed in communication with the low pressure line 156, thus allowing the connecting rod 40 and sleeve 24 to be extended upon the filling of chamber 188; when sleeve 24 is fully extended, the mechanically actuated air valve switch 254 is tripped by connecting rod 40 and mechanical connection 256, thus placing air supply line 46 in communication with DIFFERENTIATOR 258 by way of line 260; the resulting one-shot output pulse from DIFFERENTIATOR 258 is delivered via line 262 to the reset input of valve 180, said valve being responsive to place pumping chamber 158 in communication with the line 156. Likewise, prior to the point in time when piston 26 and sleeve 22 retract, but subsequent to the precompression effected by piston 28, valve 126 has switched to its center position in order that the fluid residing in chamber 134 may be coupled via line 130 to the hydraulic motor 136, and metered by the latter. This switching of valve 126 is effected in a manner similar to that previously described with respect to the precompression by piston 26 and, therefore, need be only briefly summarized here as follows: the low pressure line 78 having been coupled with the pumping chamber 158, back pressure in lines 156 and 78 begins to accumulate as piston 28 effects precompression of the food product; upon such back pressure reaching a prescribed level (indicating that precompression has been consummated), valve switch 106 is actuated to provide a signal input to NOT 52 whose output is a simultaneously delivered to NOT's 54 and 56 to kill any signals that might be coming through NOT's 54 and 56 from lines 155 or 155A. This action exhausts all signals on lines 124 and 122 to the reset and set inputs, respectively, of the four-way valve 126, thereby switching said valve to its center position whereby to place chambers 132 and 134 in communication with hydraulic motor 136. The control system at this point is conditioned to a state corresponding to the sequence depicted in FIG. 5. When piston 26 completes its displacement stroke and is about to retract, the set input of valve 98 is triggered to place the retract chamber 132 in communication with the low pressure pumping line 100, while pumping chamber 94 is coupled to hydraulic line 264. Likewise, the set input to valve 126 has been triggered to couple line 264 to the fluid return via lines 265, 266 and 80, while maintaining line 130 in communication with hydraulic motor 136; thus, the fluid within chamber 94 is returned to the supply 66 without metering the same.

When sleeve 22 and piston 26 are fully retracted, the previously discussed reset signal on line 190 triggers valve 194 which results in the extension of sleeve 22. Sleeve 22 having completed its extension, valve switch 268 is actuated and the previously discussed reset signal on line 192 is delivered to the reset input of valve 98, thereby enabling cylinder 82 to extend under the low pressure influence of line 100, while coupling chamber 132 via line 128 to line 264. It is important to note at this point that valve 126 remains in its set position to permit the fluid displaced from chamber 132 to be delivered to the fluid supply 66, while continuing to maintain hydraulic motor 136 in communication with chamber 134, in order that fluid being displaced from the latter chamber may be metered. As noted above, when cylinder 82 completes the precompression sequence, the set input on line 122 to valve 126 goes low, resulting in said valve switching to its center position wherein both chambers 132 and 134 are placed in fluid communication with hydraulic motor 136. From the foregoing it is amply clear that chambers 132 and 134 are simultaneously coupled with hydraulic motor 136, except during those periods when the retract, reload or precompression sequences are being carried out by either of the piston/-sleeve combinations. Moreover, it is evident that fluid chambers 132 and 134 each comprise reservoir means to contain a quantity of pumping fluid which corresponds to the quantity of food product within the food product pumping chambers.

Assuming now that piston 28 is pumping to displace food product, the fluid within chamber 134 is likewise being displaced to drive hydraulic motor 136, which results in the metering of the fluid thusly displaced in a manner identical to that of the metering of the fluid displaced from the chamber 132. However, the counts produced by the fluid metered from chamber 134 are simply added to, or "accumulated" with, those counts previously produced by the metering of fluid from chamber 132, in order that the "discrete portion" measured out by counter 204 and product flow valve 216 may actually comprise an accumulation of successively produced amounts of the product, effected through a series of pumping cycles by both of the piston/sleeve combinations.

It will be observed that the method and apparatus disclosed herein provides for the particularly reliable accomplishment of the objects of the invention. It is recognized, of course, that those skilled in the art may make various modifications or additions to the preferred embodiment chosen to illustrate the invention without departing from the gist and essence of our contribution to the art. Accordingly, it is to be understood that the protection sought and to be afforded hereby should be deemed to extend to the subject matter claimed and all equivalents thereof fairly within the scope of the invention.

Having thus described the invention, what is claimed as new and desired to be secured by Letters Patent is:

1. In a method of portioning viscous products dispensed as a result of movement of a pumping member by fluid on one side thereof, the improvement which comprises the steps of:

displacing fluid with said member from the opposite side thereof simultaneously with said movement and at a predetermined relationship to the volume of product being dispensed;

sensing when a certain selected volume of fluid, corresponding to the desired portion of product to be obtained, has been displaced from said opposite side of the member; and in response to said sensing step, temporarily interrupting further dispensing of the product.

2. In a product pumping system, the improvement comprising:

a pump including a member reciprocable within a cylinder having a pair of chambers defined on opposite sides of said member, movement of the member in one direction causing products to be dispensed by the pump;

means for introducing pressurized fluid into one of said chambers for effecting said movement of the member;

means for supplying fluid to the other of said chambers such that fluid is displaced from said other chamber by said movement of the member, said displacement of fluid from said other chamber occuring at a known, predetermined relationship to the volume of materials being dispensed;

means for sensing when a certain selected volume of fluid, corresponding to the desired portion size of product to be dispensed, has been displaced from said other chamber; and means operable in response to the sensing of said certain, selected volume of fluid to temporarily stop further operation of said pump.

3. In a system as claimed in claim 2; means for blocking dispensing of product from the pump during a certain initial amount of said movement of the member whereby to precompress the product prior to dispensing the same; and means operable to cause fluid being displaced from said other chamber during said certain initial amount of movement of the member to bypass said sensing means.

4. In a product pumping and portioning system, the improvement including:

a pair of pumps;

a conduit common to said pumps for receiving product therefrom;

a valve assembly between said conduit and the pumps, said assembly being operable to communicate the pumps in alternating sequence with the conduit such that product is supplied to the conduit essentially continuously from alternating ones of the pumps;

fluid pressure means coupled with said pumps for operating the same in generally alternating sequence corresponding to their alternating communication with said conduit, each of said pumps including a member reciprocable within a cylinder having a pair of chambers defined on opposite sides of the member, said fluid pressure means being operable to introduce fluid into one of said chambers of each pump for moving the member thereof in a direction that will dispense product to the conduit, said fluid pressure means further being operable to supply fluid to the other chamber of each pump such that fluid is displaced from said other chamber of each pump by said movement of its member, said displacement of fluid from the other chamber of each pump occuring at a known, predetermined relationship to the volume of product being dispensed by the corresponding pump;

means for sensing when a certain, selected volume of fluid, corresponding to the desired portion of product to be dispensed, has been displaced from said other chambers of the pumps; and means operable in response to the sensing of said certain, selected volume of fluid to temporarily stop further operation of the pumps.

5. In a product pumping system, the combination of:

a pair of reciprocable product pumps having individual product outlets;

a conduit common to said outlets for receiving product from the same and for conveying the product to a remote location;

a valve assembly between said conduit and the outlets, said assembly being operable to communicate the outlets in alternating sequence with the conduit such that product is supplied to the conduit from alternate ones of the pumps;

fluid pressure means coupled with said pumps for operating the same in generally alternating sequence corresponding to their alternating communication with said conduit, said fluid pressure means including a fluid discharge line from each of said pumps respectively that is operable to receive fluid from its corresponding pump during the time product is supplied thereby to the conduit;

fluid-receiving structure;

multi-condition valve means coupled with said discharge lines and operable in a first condition thereof to communicate one of said discharge lines with the structure and not the other, in a second condition thereof to communicate the other of said discharge lines with the structure and not said one line, and in a third condition thereof to communicate both of said discharge lines simultaneously with said structure; and control means for placing said valve means in said first condition when the outlet of said one pump is communicated by the valve assembly with said conduit to the exclusion of the outlet of said other pump, for placing said valve means in said second condition when the outlet of said other pump is communicated by the valve assembly with said conduit to the exclusion of the outlet of said one pump, and for placing said valve means in said third condition during the interval that the supply to the conduit is switched from said one pump to the other by said valve assembly.

6. In a product pumping system as claimed in claim 5, wherein said structure comprises part of a portion control mechanism, said structure being sensitive to the flow of fluid therethrough, said mechanism further including a portion control valve coupled with said conduit to open and close the latter, said mechanism further including means for operating said portion control valve when certain, predetermined fluid conditions are obtained as determined by said structure.

* * * * *